US005433481A

United States Patent [19]

Corbishley

[11] Patent Number: 5,433,481

[45] Date of Patent: Jul. 18, 1995

[54] DOCUMENT FILE

[76] Inventor: Thomas S. Corbishley, 42 Oakleigh Drive, Croxley Green, Rickmansworth WD3 3EF, Hertfordshire, United Kingdom

[21] Appl. No.: 208,944

[22] Filed: Mar. 9, 1994

[30] Foreign Application Priority Data

Mar. 17, 1993 [GB] United Kingdom ..... 9305464

[51] Int. Cl.[6] ..... B42D 3/00

[52] U.S. Cl. ..... 281/45; 493/947

[58] Field of Search ..... 493/947; 281/45, 15.1, 281/29, 51; 40/359; 402/80 R, 70

[56] References Cited

U.S. PATENT DOCUMENTS 5,174,606 12/1992 Hure ..... 493/947

FOREIGN PATENT DOCUMENTS

WO9117096 11/1991 European Pat. Off. .
191930 1/1923 United Kingdom .
970495 1/1962 United Kingdom .
2217264 10/1989 United Kingdom .
2227457 8/1990 United Kingdom ..... 493/947
0220874 3/1992 United Kingdom .

*Primary Examiner*—Willmon Fridie
*Attorney, Agent, or Firm*—Christie, Parker & Hale

[57] ABSTRACT

A document file comprises a front cover, a side flap, and two end flaps all connected to a rear cover by hinges. The side flap is connected in use to the end flaps by means of tongues formed on the end flaps which protrude through slits formed in the side flap. The slits are inclined to permit relative sliding movement between the flaps to vary the capacity of the file. Similarly, the front cover can be slidably connected to the side flap by engagement between tongues on the front cover with recessed edges formed in the side flap.

8 Claims, 5 Drawing Sheets

DOCUMENT FILE

FIELD OF THE INVENTION

This invention relates to a document file.

BACKGROUND ART

Various methods are known for forming a document file which has a front cover and a rear cover provided with a pocket. In one method, the pocket is connected to the cover with a pair of gussets which allow the pocket to expand to vary the capacity of the file. Gusseting involves expensive tooling and a document file formed by this method cannot be stored totally flat. Further, a glueing or welding operation is required to fix the pocket in the file. In another method, the pocket is formed by two or more flaps which are not held together with a resulting loss of security in retaining documents in the file. In another file, a pocket is formed by a side flap and a pair of end flaps which are held in position by elastic bands when the file is closed.

SUMMARY

It is accordingly an object of this invention to provide a new or improved document file which can be formed entirely from a single sheet of material, which provides security for documents held therein, and which can be adjusted to vary its capacity.

According to this invention, there is provided a document file comprising a front cover and a rear cover connected together by a first hinge such that the front cover can be folded to a closed position overlying the rear cover, a side flap connected to the rear cover by a second hinge and overlying the rear cover in use, and an end flap connected to the rear cover by a third hinge and overlying the rear cover in use; wherein a sliding connection is formed between the side flap and the end flap and/or between the front cover and the side flap to hold the two parts together in overlying relationship and to permit only limited relative sliding movement therebetween along a linear path to vary the capacity of the file.

Preferably, the or each sliding connection is formed by a pair of oppositely directed tongues formed in one of the parts and a pair of parallel guide edges formed on the other part wherein the tongues hook over respective guide edges and can slide therealong to vary the capacity of the file.

In a first embodiment a sliding connection is formed between the side flap and the end flap. In this embodiment the parallel guide edges are provided by the edges of a slit formed in the side flap and the oppositely directed tongues are formed on the end flap and protrude through the slit in opposite directions to hook over the edges thereof. The sliding connection in this case may be difficult or impossible to release.

In a second embodiment a sliding connection is formed between the front cover and the side flap. In this embodiment the parallel guide edges are provided on the side flap at opposite ends thereof and the oppositely directed tongues are formed on the front cover at opposite ends thereof; the spacing between the tongues corresponding to the spacing between the guide edges and the guide edges having ends to limit the sliding movement of the tongues therealong. The sliding connection in this case can be readily released.

The most preferred embodiment, is provided with two end flaps and sliding connections are formed both between the side flap and the end flaps and between the front cover and the side flap.

Preferably the document file is made entirely by cutting and folding a single sheet of plastic material.

DESCRIPTION OF THE PREFERRED EMBODIMENTS

Figure 1:
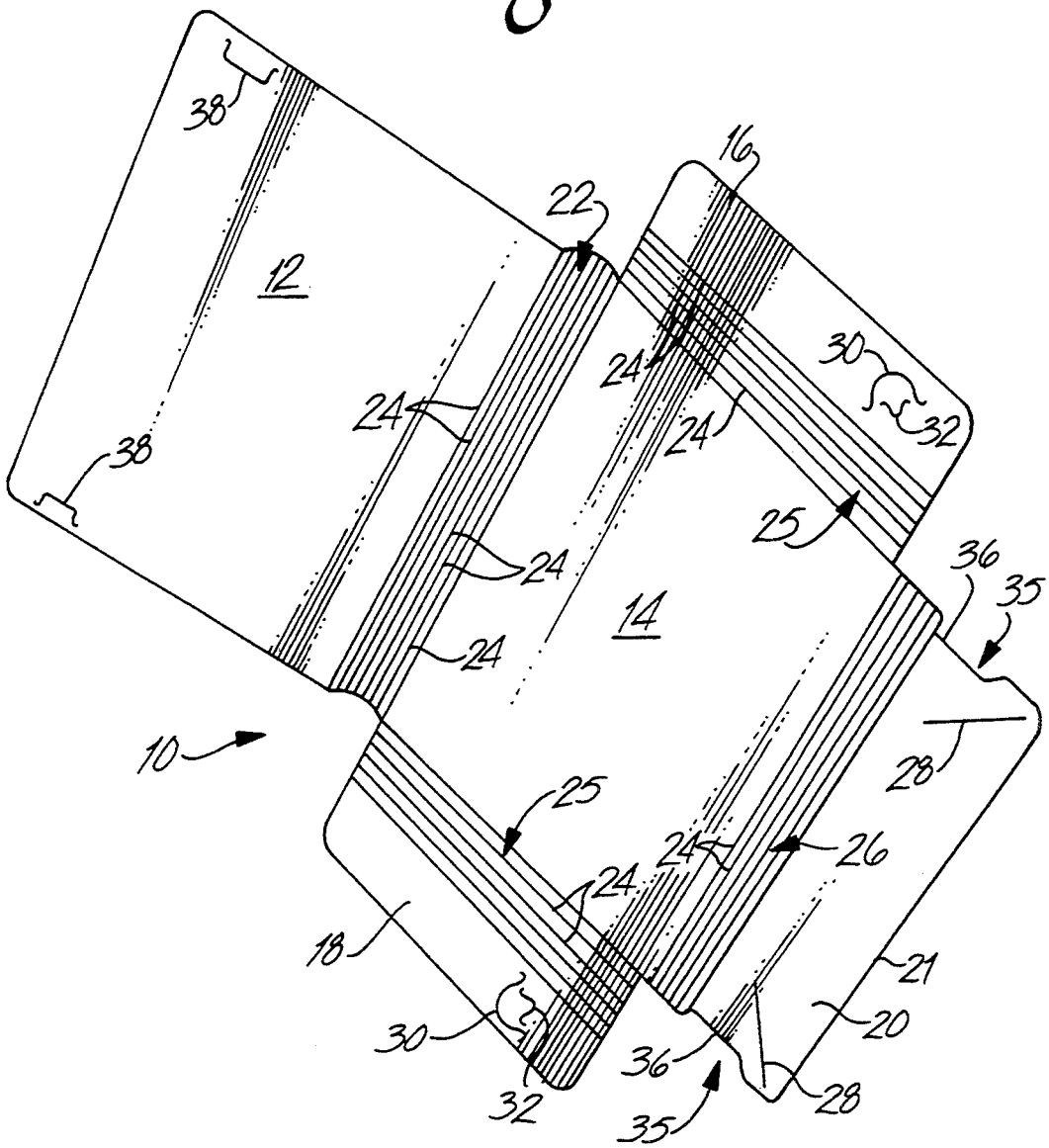
FIG. 1 is a perspective view of a document file embodying this invention in an unassembled and fully opened out state.

Referring now to FIG. 1, there is shown a document file 10 in an unassembled fully opened out state. The document file 10 is formed entirely from a single sheet of polypropylene of a thickness about 0.5 mm. This choice of material gives good strength and stiffness whilst being sufficiently flexible. By way of alternative, document file 10 may be formed from other types of plastic sheet material, for example polyvinylchloride, or even from card if a very durable file is not required.

The document file 10 comprises a rectangular front cover 12, a rectangular rear cover 14, top and bottom end flaps 16, 18 and a side flap 20 provided on the rear cover 14. In another embodiment (not shown) only one end flap may be provided. The front and rear covers 12, 14 are connected by a spine in the form of a hinge 22. The hinge 22 has a plurality of longitudinally scored parallel hinge lines 24. The front and rear covers 12, 14 can pivot relative to each other about the hinge 22 between an open position and a closed position in which the front cover overlies the rear cover.

The end flaps 16 are connected to the rear cover by similar hinges 25 and the side flap is connected to the rear cover by a similar hinge 26. The hinges 22, 25 and 26 enable the front 12 cover and flaps 16,18,20 to be folded to overlie the rear cover to a variable degree. Thus if the front cover and flaps are folded inwardly about only the innermost hinge lines 24 they will lie flat on the rear cover. In this position, the file has minimum capacity and lies flat for storage. When documents are added to the file, further hinge lines are brought into operation such that the front cover and flaps overlie the rear cover to a lesser degree and are spaced from it.

Figure 3:
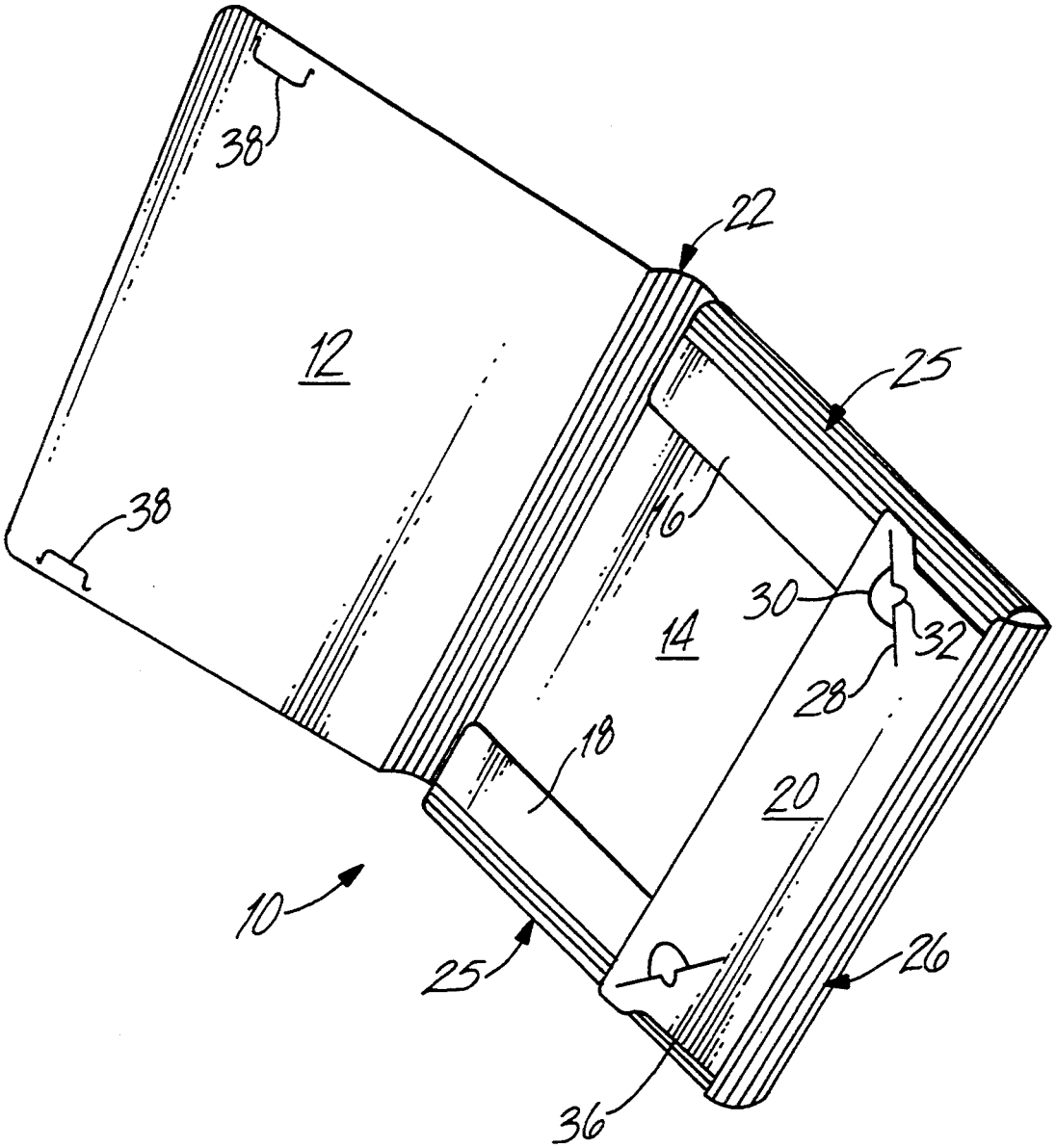

The side flap 20 is provided with a pair of slits 28. Each slit 28 extends inwardly from a position adjacent one of the outer corners of side flap 20 and at an angle of approximately 45° to the outermost edge 21 of side flap 20. As can be seen in FIG. 3, the slits extend in directions across the corner of the file when the side flap overlies the rear cover. Each of the end flaps 16, 18 is provided with a first tongue 30 and a second, oppositely directed and smaller tongue 32. As will be explained below, the slits 28 and tongues 30, 32 connect the end flaps 16, 18 to the side flap 20 when the document file 10 is in an assembled state.

Recesses 35 formed at the opposite ends of the flap 20 have parallel edges 36. A pair of inwardly directed tongues 38 are formed at opposite ends of the front cover 12 at positions adjacent the top and bottom edges thereof. As will be explained below, the tongues 38 can hook over the edges 36 of the top and bottom recesses 35 of the side flap 20 when the front and rear covers 12, 14 are in the closed position so as to secure the front cover 12 in position. It should be noted that the spacing between the tongues 38 and the spacing between the edges 36 are kept constant by the material extending therebetween. It should also be noted that the recessed edges 36 are longer than the tongues, but have ends to limit the sliding movement of the tongues therealong.

Figure 2:
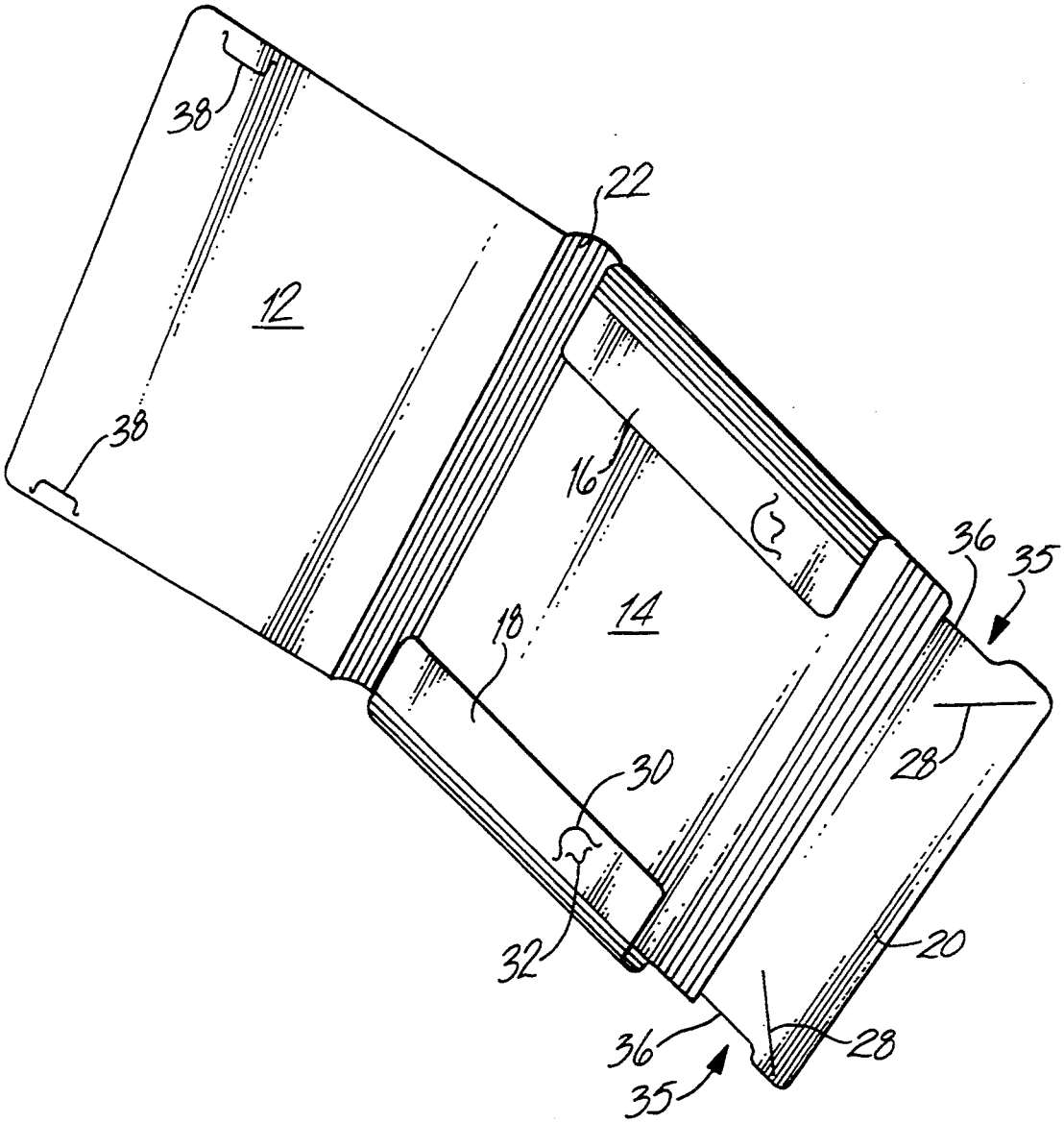
FIGS. 2 and 3 are perspective views showing the method of forming a pocket for the rear cover of the document file of FIG. 1.

In order to form a pocket with the rear cover 14, the end flaps 16, 18 are folded inwardly as shown in FIG. 2. Then, as shown in FIG. 3, the side flap 20 is folded inwardly and the tongues 30, 32 are pushed through slits 28. Consequently, each pair of tongues 30, 32 protrudes through a respective one of slits 28 but the tongues of each pair protrude in opposite directions to each other. The engagement of the tongues 30, 32 of the bottom end flap 18 and the bottom slit 28 of the side flap 20 is illustrated at an enlarged scale in FIG. 4.

Figure 4:
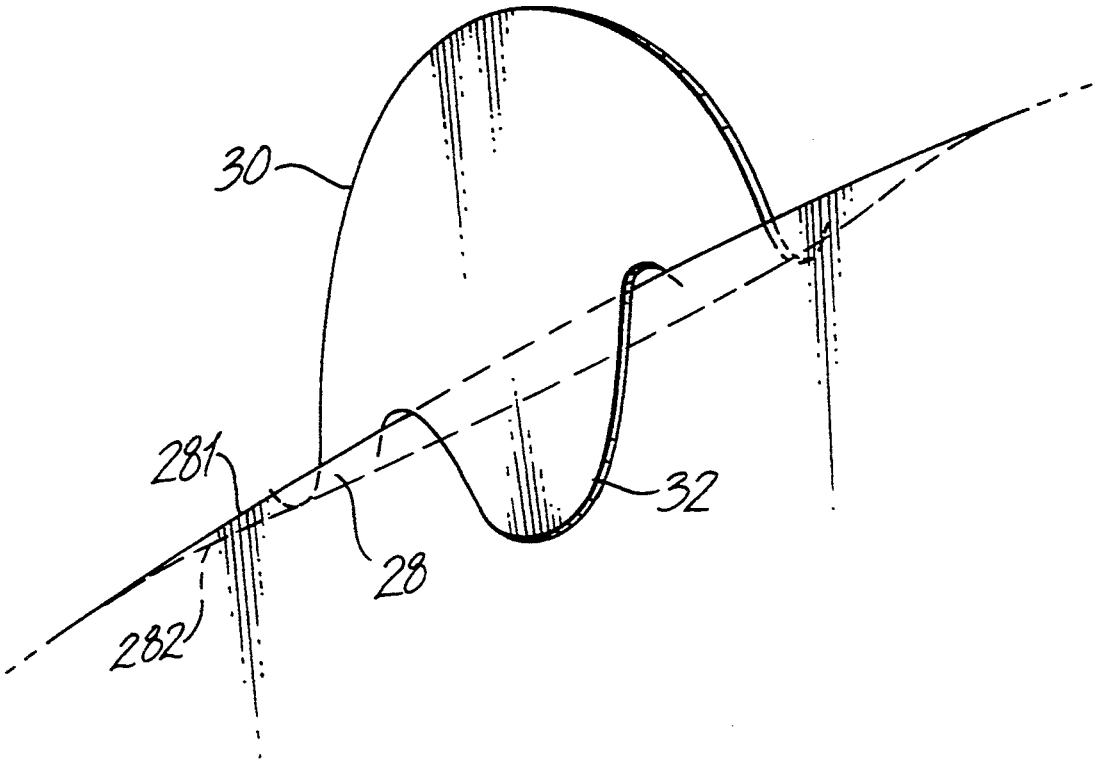
FIG. 4 is a sketch on an enlarged scale showing the connection between the side flap and one of the end flaps of the rear cover.

As can be seen most clearly in FIG. 4, the tongues 30 and 32 hook over the opposite edges 281,282 of the slit 28 which bear against the roots of the tongues which lie on a common line. The tongues 30, 32 and the slits 28 thus connect the end flaps 16, 18 and the side flap 20 together. The connection retains the side flap 20 and the end flaps 16, 18 in positions overlying the rear cover 14 whilst permitting relative sliding movement between the side flap and the end flap along the linear path provided by the slit 28 to vary the capacity of the file. In this sliding movement the edges of the slit 28 act as guide edges for the tongues 30, 32. Tongues 30, 32 ensure that the flaps are locked together and cannot burst open. As the capacity of the file increases the hinges 25,26 enable the flaps 16,18,20 to move progressively outwardly such that they overlie the rear cover to a lesser extent. During this movement they slide over one another but are held together by the tongues 30, 32 which slide along the length of the slits 28. Thus a sliding connection is formed between the side flap 20 and each end flap 16, 18 to provide a variable capacity pocket.

Figure 5:
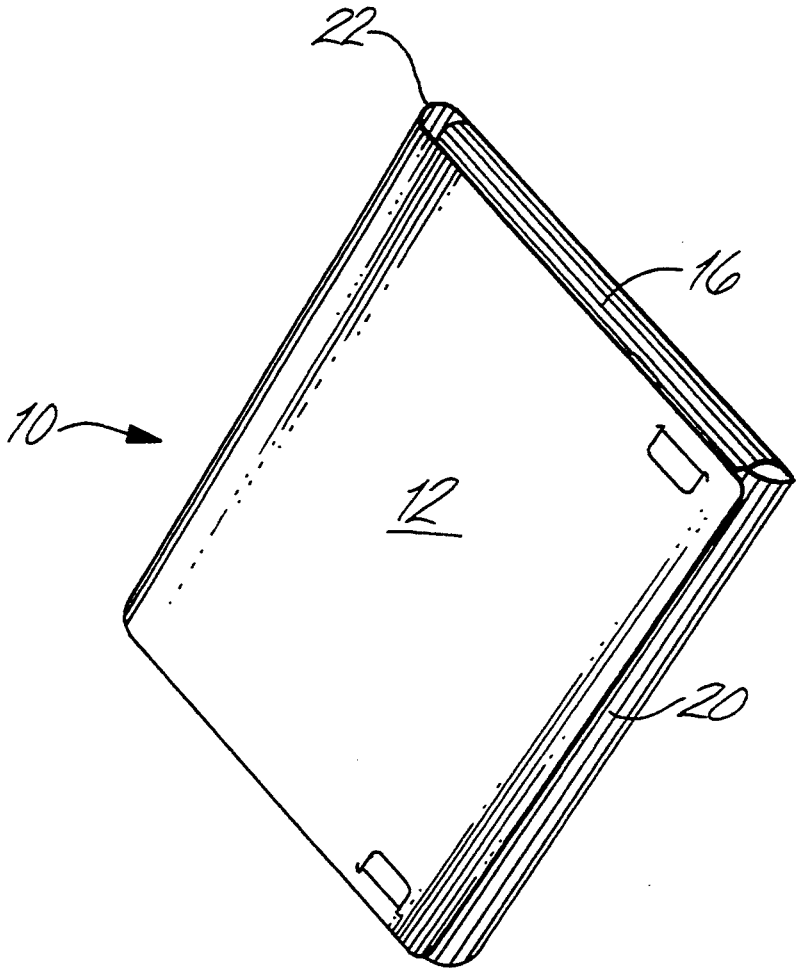
FIG. 5 is a perspective view of the document file of FIG. 1 with the front and rear covers in a closed position.

FIG. 5 shows the front and rear covers 12, 14 folded into a closed position. With the covers 12, 14 in this position, the tongues 38 can be hooked over the edges 36 of the recesses 35 in the side flap 20 such that the edges 36 bear against the roots of the tongues, thereby securing the front cover 12 to the side flap 20. Consequently, there is no need to make further provision for securing the front cover 12 in the closed position.

When the document file has no papers in it, the front cover 12 may be laid flat on the rear cover 14. As the document file is filled with papers, the spacing between the front and rear covers 12, 14 in the closed position increases and the hinge 22 adopts a U-shaped configuration. With the tongues 38 hooked over the edges 36, limited sliding movement is possible between the front cover 12 and the side flap 20. In this sliding movement the edges 36 act as guide edges for the tongues 38. Thus a releasable sliding connection is formed between the front cover and the side flap. This assists in the ability of the file 10 to change its configuration in the closed position in accordance with the thickness of documents contained within it.

In comparison with a document file in which a pocket is connected to the rear cover with a gusset, the document file described provides the advantages that glueing or welding is not required in fabricating the file and the file can be stored totally flat. In comparison with a document file in which a pocket is formed with unsecured flaps, document file 10 provides the advantage that documents are retained more securely in the pocket.

If it is not desired to secure the front cover 12 in the closed position, the recessed edges 36 and tongues 38 may be omitted. Alternatively, the tongues 30, 32 and slits 28 may be omitted while retaining the tongues 38 and recessed edges 36. In this alternative arrangement, the flaps 16, 18, 20 will not be held together when the covers 12, 14 are in the open position. However, when the covers 12, 14 are in the closed position, engaging the tongues 38 over the recessed edges 36 will have the effect of holding the side flap 20 in position. Since the side flap 20 partly overlies the end flaps 16,18 it retains them in position. The file 10 will still be secure whilst having the ability to change its configuration in the closed positions in accordance with the thickness of documents contained within it.

In another embodiment (not shown) the recessed edges 36 may be replaced by slits which provide the guide edge for tongues 38.

If it is desired to provide each cover with a pocket, then each cover is provided with a side flap and one or more end flaps.

The connections between the side flap 20 and the end flaps are made and released by manipulating and distorting the material of the file. Once the file has been formed from the blank, it will not normally be necessary to release these connections. Because of the design of these connections, they have a very good resistance to accidental release.

The connection between the front cover and the side flap is also made and released by manipulation and distortion of the material of the file. These connections are designed to be more easily made and released since this is done throughout the life of the file.

I claim:

1. A document file comprising a front cover and a rear cover connected together by a first hinge such that the front cover can be folded to a closed position overlying the rear cover, a side flap connected to the rear cover by a second hinge and overlying the rear cover in use, and a pair of end flaps connected opposite one another to the rear cover by third and fourth hinges and overlying the rear cover in use; wherein sliding connections are formed between the side flap and each of the end flaps to hold the two parts together in overlying relationship and to permit only limited relative sliding movement therebetween along a linear path to vary the capacity of the file; and wherein each sliding connection is formed by a pair of oppositely directed tongues formed in one of the parts and a pair of parallel guide edges formed on the other part, and wherein the tongues hook over respective guide edges and can slide therealong to vary the capacity of the file.

2. A document file as claimed in claim 1, wherein the parallel guide edges of each sliding connection are provided by the edges of a slit formed in the side flap, wherein each pair of oppositely directed tongues is formed on an end flap and wherein the tongues of each pair protrude through the slit in opposite directions to hook over the edges thereof.

3. A document file as claimed in claim 2, wherein each slit extends in a direction across the corner of the file and at an angle of 45° to the edge of the side flap.

4. A document file as claimed in claim 1, wherein a sliding connection is also formed between the front cover and the side flap and wherein the parallel guide edges thereof are provided on the side flap at opposite ends thereof and the oppositely directed tongues are formed on the front cover at opposite ends thereof; the spacing between the tongues corresponding to the spacing between the guide edges and the guide edges having ends to limit the sliding movement of the tongues therealong.

5. A document file as claimed in claim 1, wherein each hinge comprises a plurality of parallel hinge lines such that the positions of the front cover and of the flaps when overlying the rear cover are movable to vary the capacity of the file.

6. A document file as claimed in claim 1, wherein the file is made entirely by cutting and folding a single sheet of material.

7. A document file as claimed in claim 6, wherein the material is polypropylene.

8. A document file as claimed in claim 1, wherein a sliding connection is formed between the front cover and the side flap and wherein the parallel guide edges thereof and the oppositely directed tongues are formed on the front cover at opposite ends thereof; the spacing between the tongues corresponding to the spacing between the guide edges and the guide edges having ends to limit the sliding movement of the tongues therealong.

* * * * *